US010046479B2

(12) United States Patent
Lehnert et al.

(10) Patent No.: US 10,046,479 B2
(45) Date of Patent: Aug. 14, 2018

(54) TOOL HOLDER AND COMBINATION OF A TOOL HOLDER AND TOOL

(71) Applicants: Wirtgen GmbH, Windhagen (DE); Betek GmbH & Co. KG, Aichhalden (DE)

(72) Inventors: Thomas Lehnert, Oberraden (DE); Karsten Buhr, Willroth (DE); Cyrus Barimani, Königswinter (DE); Heiko Friederichs, Aichhalden (DE); Karl Kammerer, Fluorn-Winzeln (DE); Markus Roth, Aichhalden (DE)

(73) Assignees: Wirtgen GmbH (DE); Betek GmbH & Co. KG (DE)

( * ) Notice: Subject to any disclaimer, the term of this patent is extended or adjusted under 35 U.S.C. 154(b) by 100 days.

(21) Appl. No.: 15/023,717

(22) PCT Filed: Sep. 1, 2014

(86) PCT No.: PCT/EP2014/068497
§ 371 (c)(1),
(2) Date: Mar. 22, 2016

(87) PCT Pub. No.: WO2015/043883
PCT Pub. Date: Apr. 2, 2015

(65) Prior Publication Data

US 2016/0229084 A1 Aug. 11, 2016

(30) Foreign Application Priority Data

Sep. 26, 2013 (DE) ..... 10 2013 110 680

(51) Int. Cl.
*E21C 35/19* (2006.01)
*E21C 35/193* (2006.01)
*B28D 1/18* (2006.01)

(52) U.S. Cl.
CPC ..... *B28D 1/186* (2013.01); *E21C 35/19* (2013.01); *E21C 35/1933* (2013.01)

(58) Field of Classification Search
CPC ..... E21C 35/193; E21C 35/1933; E21C 35/1936; E21C 35/18; E21C 35/19; E21C 35/197; B28D 1/186
See application file for complete search history.

(56) References Cited

U.S. PATENT DOCUMENTS 4,240,669 A 12/1980 Rollins
4,921,310 A * 5/1990 Hedlund ..... E21C 35/197 299/107

(Continued)

OTHER PUBLICATIONS

Co-pending U.S. Appl. No. 15/023,718, filed Mar. 22, 2016.

*Primary Examiner* — David J Bagnell
*Assistant Examiner* — Michael A Goodwin
(74) *Attorney, Agent, or Firm* — Lucian Wayne Beavers; Patterson Intellectual Property Law, PC

(57) ABSTRACT

A chisel holder for a ground processing machine includes a base portion including a chisel receiver and a holder receiver. The chisel receiver includes a chisel introduction region for receiving a threaded shaft of a chisel. The holder receiver is configured to receive an internally threaded nut. The holder receiver includes at least one retention face configured to secure the nut against rotation at a peripheral side or the nut.

15 Claims, 13 Drawing Sheets

(56) References Cited

U.S. PATENT DOCUMENTS

| | | | | |
|---|---|---|---|---|
| 5,007,685 | A * | 4/1991 | Beach | E21C 35/1933 299/103 |
| 5,992,405 | A * | 11/1999 | Sollami | B28D 1/188 125/36 |
| 6,321,623 | B1 * | 11/2001 | Dykes | B25B 13/065 411/402 |
| 6,364,420 | B1 * | 4/2002 | Sollami | B28D 1/188 299/104 |
| 6,712,431 | B1 * | 3/2004 | Bosch | E21C 35/197 299/104 |
| 2008/0223744 | A1 | 9/2008 | Tewes et al. | |
| 2011/0148179 | A1 | 6/2011 | Lehnert et al. | |
| 2012/0080930 | A1 | 4/2012 | Latham | |
| 2012/0132740 | A1 * | 5/2012 | Cascio | B02C 4/08 241/278.1 |
| 2012/0272552 | A1 | 11/2012 | Tack | |
| 2014/0117741 | A1 | 5/2014 | Lehnert et al. | |
| 2014/0191562 | A1 * | 7/2014 | Greenspan | E02F 9/2866 299/101 |

* cited by examiner

TOOL HOLDER AND COMBINATION OF A TOOL HOLDER AND TOOL

FIELD

The invention relates to a chisel holder for a ground processing machine, in particular a road milling machine having a base portion which has a chisel receiving member, wherein the chisel receiving member has a chisel introduction region, and wherein the chisel receiving member merges indirectly or directly into a holder receiving member for receiving a nut or the like. The invention further relates to a combination with a chisel holder and a chisel. The invention consequently relates to the technical field of ground processing machines, in particular of road construction machines, mining machines or the like.

BACKGROUND

The cutting rollers of road milling machines, mining machines or the like are usually provided with chisel holder changing systems. In this instance, base portions of the chisel holder changing systems can be connected to the surface of a cutting roller pipe, in particular welded or screwed thereto. In this instance, the base portions are positioned relative to each other so that helical loading members are produced on the surface of the cutting roller. Chisel holders are connected to the base portions, wherein the chisel holders may be screwed, welded or otherwise retained with respect to the base portion, for example, clamped. In the simplest case, the chisel holders may also be directly connected to the surface of a cutting roller pipe. The chisel holders have a chisel receiving member. The chisels described above can be mounted therein so as to be able to be replaced. During use of the machine, the chisels strike with the chisel tips thereof the substrate which is intended to be removed and cut into it. In this instance, the ground material is broken up. The material which has been removed in this manner can be transported, for example, via the helical broaching and loading members toward the center of the cutting roller and conveyed out of the operating region of the cutting roller at that location by means of ejectors. The material can then be transported away using appropriate devices, for example, transport belts. The chisels are provided with chisel tips, which comprise hard material and which bring about the cutting engagement. They are consequently subjected to an abrasive attack and must therefore comprise a suitable hard material in order to achieve the longest possible service-life. From the prior art there are known chisels in which the chisel tip comprises hard metal. In order to be able to generate uniform wear at the periphery with such chisels, the chisels are generally rotatably arranged in chisel receiving members of the chisel holders.

There are also known chisels which are provided in the region of the chisel tips thereof with a "superhard material". For example, the chisel tips have a coating of polycrystalline diamond or another material which has a hardness which is comparable with diamond. Such a chisel is known from US 2012/0080930 A1. Such chisel tips have an extraordinarily long service-life and exhibit hardly any wear during operational use. It is therefore not absolutely necessary to fix these chisels in a rotatable manner in the chisel holders. US 2012/0080930 A1 therefore proposes providing the chisel shaft of the chisel with a thread and clamping the chisel securely to the chisel holder by means of a nut. If after a specific operating time wear appears on the chisel, the nut can be released, the chisel can be rotated slightly and the nut can then be retightened.

In this instance, in the spatial distance between the outer periphery of the nut and the inner periphery of a holder receiving member in which the nut is inserted, a tool wrench is inserted. The rear region of the chisel holder which forms the holder receiving member can be accessed only with difficulty so that the chisel change is complex. In addition, ground material which is removed during operational use can be introduced in the spatial distance mentioned above and be compressed therein. The spatial distance then has to be scratched free. The clearance of the spatial distance is particularly complex in road milling machines since the bitumen material which has been removed sets hard as a sticky mass in the spatial distance. This results in long machine downtimes for the chisel change.

Another disadvantage is that no indexing is provided, that is to say, the chisel can be clamped in any position which is rotated about the longitudinal axis thereof. Once released it can hardly be clamped again any more in the same position, be clamped again in a position rotated through a specific angle or be clamped again at the same angle as an adjacent chisel.

BRIEF SUMMARY

An object of the invention is to provide a chisel holder or a combination with a chisel holder and a chisel which enable(s) simplified maintenance.

In order to provide simplified maintenance, another object of the invention is to provide a method for assembling a chisel in a chisel holder.

The object relating to the chisel holder is achieved in that the holder receiving member has at least one retention face for securing the nut at the peripheral side.

With such a chisel holder, it is not necessary to use a tool at the rear in order to tighten the nut. In the solution according to the invention, the nut is supported directly on the retention faces of the holder receiving member which secure the nut in a rotationally secure manner and the torque for tensioning the chisel is introduced via the chisel head. Therefore, in particular the screwing of the chisel can take place from the front side of the tool holder alone. This region is readily accessible for corresponding tools. Even if, with the solution according to the invention, waste material were to accumulate in the very narrow region between the retention faces and the nut, this is non-critical since, as a result of the support of the nut on the retention faces, a torsion-resistant securing action, which is required for the release of the chisel, is always ensured. In this manner, simple machine maintenance is possible. In particular using such a solution, the chisel can be rotated into the desired operating position in a rapid and uncomplicated manner or, in the event of complete wear, can also be readily replaced.

According to a preferred construction variant of the invention, there is provision for the retention faces to be constructed so as to be curved in a convex or concave manner or at least to have convex or concave surface regions. A tension-optimized construction is thereby produced. Correspondingly curved counter-faces of the nut can be supported on the curved retention faces. With the curved construction, with respect to elongate surface portions a relatively large contact region is provided for the same structural space. Accordingly, the surface pressures can thereby be reduced.

When convex retention faces are used, there may be provision for these faces to merge into each other via concave transition portions. In order to tighten the chisels, a considerable torque is required for secure fixing. Accordingly, high tensions are also produced at the retention faces. The concave transition portions between the retention faces decrease tension peaks in these regions and enable a construction which is optimized in terms of loading.

A particularly preferred variant of the invention is such that the holder receiving member has five retention faces, which are arranged so as to be distributed in a substantially uniform manner over the periphery, preferably arranged offset with the same angular offset with respect to each other. As explained above, it is particularly necessary with chisels which are provided with superhard materials to rotate them with respect to the chisel holder after a specific period of operation so that the chisels do not become excessively worn at one side. To this end, the chisel is released by means of a suitable tool. Subsequently, the nut can be pulled out of the holder receiving member and can be inserted again therein in a rotated state. As a result of this rotation, the thread intake into the thread is also arranged in a rotated position with respect to the chisel holder. If the same chisel is now screwed again to the nut, wherein preferably the same tightening torque is intended to be selected again, the chisel head and consequently the chisel tip then moves into abutment with respect to the chisel holder in a correspondingly rotated position. The processing side of the chisel is then formed by a non-worn tool tip location. When five retention faces of the holder receiving member which are arranged so as to be distributed in a uniform manner with respect to each other are used, the chisel can also be secured to the chisel holder in five positions which are rotated with respect to each other. It has been found that such an arrangement is particularly advantageous when the chisel is used for the purpose of fine-milling of road surfaces. When rotated to the extent of a blocking face, the chisel can then be worn in an optimized manner, wherein at the same time a high surface quality of the milled road surface is maintained since all the chisels are always rotated further to the same extent.

The use of five retention faces, that is to say, therefore, an uneven number of retention faces, also enables the chisel to always be arranged in a state rotated to the extent of two retention faces until all five positions have been used. A continuous uniform wear of the chisel for the purpose of a high surface quality of the milled surface is then achieved in this instance.

A particularly preferred variant of the invention further involves the holder receiving member merging into a sealing portion. This sealing portion may, for example, be formed by a cylindrical bore region of the chisel receiving member. In cooperation, for example, with a sealing portion of the nut, a rear sealing of the region of the chisel shaft can be achieved.

If there is provision in this instance for a stop for the nut to be formed in the region of the sealing portion, the sealing portion of the nut can then be precisely orientated with respect to the sealing portion of the chisel holder and the longitudinal displacement of the nut is limited with the stop.

A chisel holder according to the invention may also be characterized in that the base portion has at the region thereof opposite the holder receiving member a curved, in particular concave, counter-face, in particular spherical counter-face. On this counter-face, a correspondingly curved support face of the chisel can be supported in a planar manner.

The spherical curvature enables with respect to a frusto-conical construction an increased surface for the same structural space. This leads to smaller surface pressures and consequently to a construction which is optimized in terms of loading. Furthermore, in cooperation with a counter-face of the chisel holder, which counter-face is curved in accordance with the support face, a type of "ball-and-socket joint" can be constructed. Such a bearing can react particularly well to the changing force directions which occur during the cutting process and can discharge these forces uniformly and reliably into the chisel holder. Tension peaks which occur in particular with impact-like loads, are thereby minimized.

A possible variant of the invention makes provision for the base portion to be constructed to be at least partially cylindrical at the outer contour thereof. The base portion can then be placed with the cylindrical surface region thereof on a correspondingly constructed hollow-cylindrical face of a lower portion and precisely orientated with respect to the cutting roller. In this manner, simple assembly of the chisel holder is possible.

The base portion may have a preferably cylindrical attachment which at least partially forms the counter-face. The cylindrical attachment may in this instance then be sized in such a manner that the high tension forces which are introduced by the chisel into the counter-face can be reliably dissipated.

During the cutting process, the forces acting on the chisel change with respect to the direction and the value. The spherically curved counter-face of the chisel holder can react particularly well to these changing force directions, as explained above. The chisel is retained with the chisel shaft thereof in the chisel receiving member of the chisel holder. If a particularly powerful pulse-like transverse force now acts on the chisel, the axial portion thereof is discharged via the support face of the chisel into the counter-face of the chisel holder. In contrast, the radial portion attempts to pivot the chisel head with respect to the tool holder; the chisel shaft is also thereby additionally stressed in terms of flexion. Finally, via the threaded connection, a tensile stress is also introduced into the chisel shaft. Consequently, in the region of the chisel shaft, an unfavorable multi-axis tension state may be produced in the region of the chisel shaft. In order to be able to achieve a load-optimized construction of the chisel holder in this instance, there is provision according to a variant of the invention for a projection and/or a recess to be arranged in the region of the counter-face which is preferably constructed in a peripheral manner. Accordingly, a corresponding projection or a corresponding recess may be arranged in the region of the support face of the chisel. If, for example, a recess is arranged on the chisel head, a projection of the chisel holder engages therein. This engagement results in a connection geometry which enables improved discharge of forces and which reduces the tensions in the chisel shaft.

Furthermore, such a construction affords the possibility of compensating for production tolerances between the spherically curved surface of the chisel and the chisel holder. If, for example, a recess is formed in the chisel head, there are formed at both sides of the recess defined abutment regions which always ensure a sufficiently reliable surface contact between the chisel and the chisel holder. For this functionality, there does not have to be provision, for example, for a projection of the chisel holder to engage in a recess of the chisel or, when a projection is arranged on the chisel, for this projection to engage in a recess of the chisel holder. In order to compensate for the surface tolerances, it is then instead simply necessary for a recess to be provided in the chisel and/or the chisel holder. It is, for example, also conceivable for the chisel holder and/or the chisel to be constructed with recesses in which a peripheral sealing element is introduced. This peripheral sealing element, for example, a copper ring, an O-ring or the like, then prevents the introduction of dirt into the region of the chisel shaft. The above-mentioned tooth arrangement, in which a projection and a recess of the chisel or the chisel holder engage in each other, can to some extent also perform such a sealing action in the form of a labyrinth-like seal.

In a particularly preferred manner, there is provision for the recess and/or the projection to extend concentrically about the longitudinal center axis of the chisel receiving member.

An object of the invention is also achieved with a combination of a chisel holder and a chisel which is retained in the chisel receiving member. In this instance, the combination may also be constructed in such a manner that the chisel has a chisel shaft which is arranged at least partially in the chisel receiving member and which has a thread portion with a thread, with which the chisel can be screwed onto a nut. The nut has a securing portion with blocking faces which are opposite the retention faces of the holder receiving member in order to secure the nut in terms of rotation. Using this construction, the chisel can be secured directly in the chisel receiving member so that it is possible to considerably reduce the component complexity.

The nut may have a sealing portion which is indirectly or directly adjacent to the securing portion and which is inserted in a sealing manner in the sealing portion of the chisel holder.

An object of the invention is also achieved with an assembly method, wherein the nut is guided on the holder receiving member, in particular introduced therein, until it is arranged at that location in a rotationally secure manner, that the chisel is then introduced into the chisel receiving member and screwed into the nut until the support face of the chisel is tensioned on the counter-face of the chisel holder.

In this instance, the assembly can be further simplified when there is provision for the nut to be retained in a non-releasable manner on the chisel holder by means of a securing element, for example, a seal, before the chisel is screwed in.

A uniform peripheral wear on the chisel is enabled in a simple manner in terms of assembly technology by the nut being able to be inserted into the holder receiving member in two or more positions which are offset relative to each other in the peripheral direction.

BRIEF DESCRIPTION OF THE DRAWINGS

The invention is explained in greater detail below with reference to embodiments illustrated in the drawings, in which.

DETAILED DESCRIPTION

Figure 1:
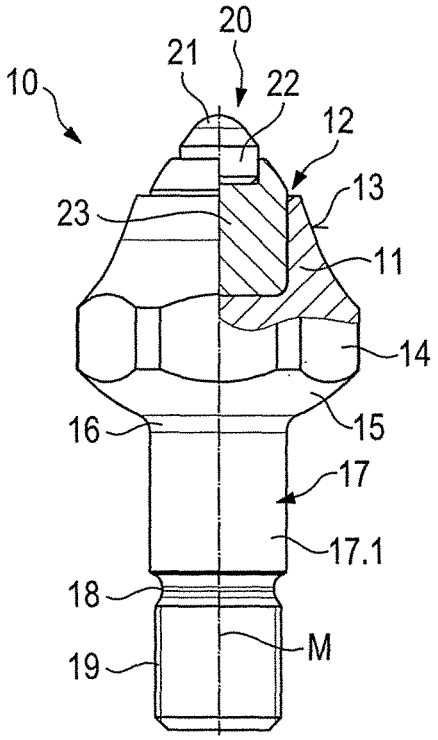
FIG. 1 is a side view and a partially sectioned view of a chisel.

FIG. 1 shows a chisel 10 having a chisel head 11 on which a chisel shaft 17 is integrally formed. The chisel head 11 has at the end thereof facing away from the chisel shaft 17 a receiving member 12 which is constructed in this instance in the form of a blind-hole-like bore. A chisel tip 20 is inserted into this receiving member 12. The chisel tip 20 has a connection portion 23 which may comprise hard metal. The connection portion 23 has at the end thereof facing away from the chisel shaft 17 a receiving member in which a carrier member 22 is inserted. The carrier member 22 comprises a hard material, for example, hard metal. It is provided at the free end thereof with a hard material coating 21. The hard material coating 21 is in this instance formed by a superhard material. In this instance, it is, for example, possible to use a material which has a similar hardness to diamond. In particular, the hard material coating 21 may comprise polycrystalline diamond. The carrier member 22 is connected to the connection portion 23 by means of a suitable connection. For example, a solder connection may be provided. The connection portion 23 may be connected to the chisel head 11 in the chisel receiving member 12 by means of a suitable connection. For example, a solder connection may be selected. The construction of the chisel tip 20, comprising the connection portion 23 and the carrier member 22 which is connected thereto with a hard material coating 21 can be produced in a simple manner. The spatially smaller carrier member 22 may be coated in a suitable coating installation with the hard material coating. The connection portion 23 of wear-resistant material is structurally larger than the carrier member 22 and therefore has a high capacity for wear.

It is also conceivable for the entire chisel tip 20 to be constructed integrally. The chisel tip could then comprise, for example, hard metal. It is further conceivable for the chisel head 11 itself to be provided with a hard material coating which forms the chisel tip and which is preferably of superhard material. The component complexity can thereby be considerably reduced.

Alternatively, it is also conceivable for the hard material coating 21 to be applied directly to the connection portion 23 with the carrier member 22 being omitted.

Alternatively, the connection portion 23 could also be constructed integrally with the carrier member 22, which would lead to a similar chisel tip, as in the preceding example, only the interface would be different.

Figure 3:
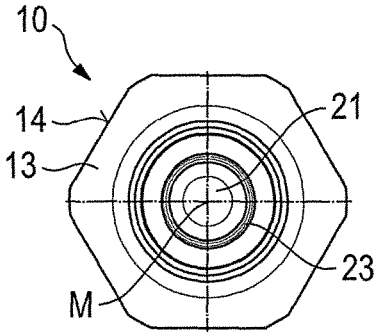
FIG. 3 is a plan view of the chisel according to FIGS. 1 and 2.
Figure 4:
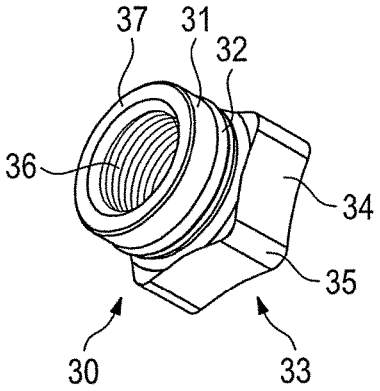
FIGS. 4 and 5 are perspective views of a nut.
Figure 5:
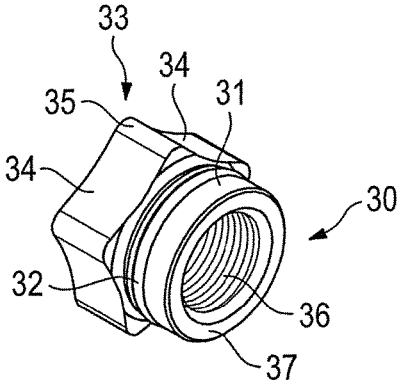

The portion of the chisel head 11 forming the receiving member 12 has a discharge face 13 which expands from the chisel tip 20 in the direction toward the shaft 17. That discharge face 13 may in particular be constructed in a concave manner, as clearly shown in FIG. 1. Adjacent to the discharge face 13, the chisel head 11 forms a tool receiving member 14. This is constructed in this instance as an external hexagonal member, as shown in FIG. 3. The external hexagonal member has a conventional wrench width for fitting a commercially available tool. Adjacent to the tool receiving member 14, the chisel head 11 forms a support face 15. The support face 15 is curved in a spherical manner. In the present embodiment, a simple-to-produce convex ball contour is used as a spherical curvature. The chisel shaft 17 is formed centrally on the support face 15 so that the support face 15 extends in a uniform manner about the longitudinal center axis M of the chisel shaft 17. The coupling of the chisel shaft 17 to the chisel head 15 is carried out in a tension-optimized manner via a transition 16 which is formed by a rounded portion. The chisel shaft 17 has a cylindrical region, which forms an expansion portion 17.1. In the region of the free end of the chisel shaft 17, a thread 19 is cut on the chisel shaft 17. A recess 18 is provided between the thread 19 and the chisel shaft 17.

Figure 6:
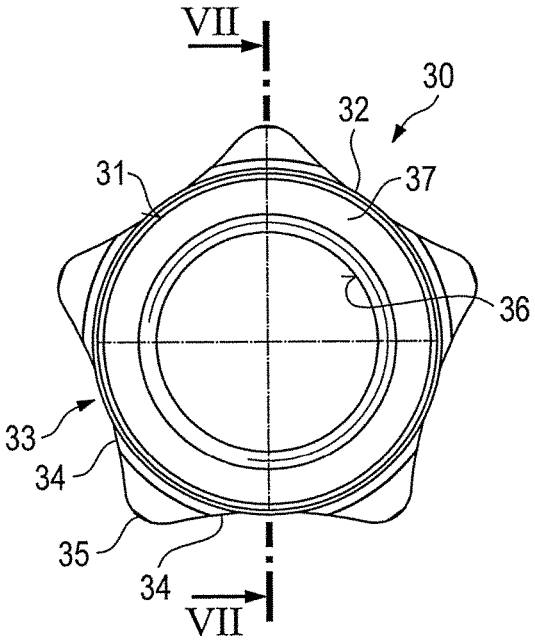
FIG. 6 is a plan view of the nut according to FIGS. 4 and 5.
Figure 7:
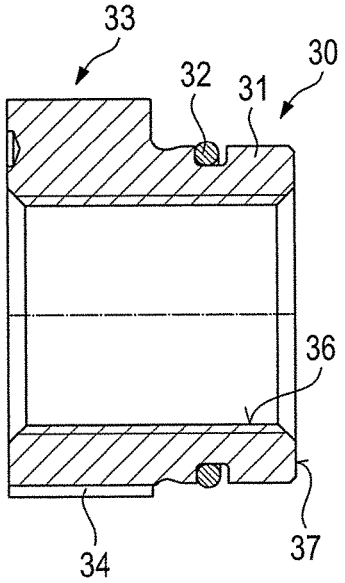
FIG. 7 is a line of section indicated VII-VII in FIG. 6.

The nut 30 shown in FIGS. 4 to 7 can be screwed to the thread 19. As these drawings show, the nut 30 has a sealing portion 31 in the form of a cylindrical attachment. In the outer periphery of the sealing portion 31 there is formed a groove which can clearly be seen in FIG. 7. This groove serves to receive a seal 32 which is constructed in this instance as an O-ring. A securing portion 33 adjoins the sealing portion 31. The securing portion 33 has blocking faces 34 which are constructed in a concave-curved manner. The blocking faces 34 merge into each other via convex transition portions 35. As shown in FIG. 6, the nut 30 has five blocking faces 34 which are arranged so as to be distributed in a uniform manner with the same angular spacing over the outer periphery of the nut 30. The thread 36 extends through the nut 30. In a state adjacent to the thread 36, the nut 30 has in the region of the sealing portion 31 a radial impact face 37.

Figure 2:
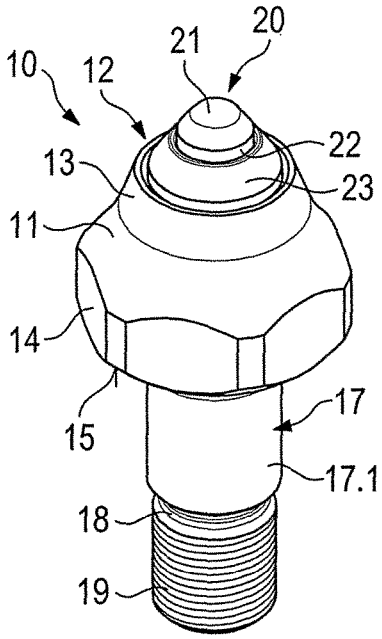
FIG. 2 is a perspective view of the chisel according to FIG. 1.

FIGS. 8 to 11 show a chisel holder 40 for receiving the chisel 10 shown in FIGS. 1 to 3. The chisel holder 40 has a base portion 41 which has a cylindrical outer contour. At the upper end thereof, the chisel holder 40 has a cylindrical attachment 42. The cylindrical attachment 42 may include, in a non-limiting example, at least one surface contour 43 such as at least one of a peripheral projection and a peripheral recess arranged on the base portion 41. In this instance, the diameter of the cylindrical attachment 42 is selected to be slightly larger than the diameter of the base portion 41. The cylindrical attachment 42 forms a counter-face 44 which is constructed so as to be curved in a spherical manner and concave. The chisel holder 40 merges in a manner adjacent to the counter-face 44 into a chisel receiving member 45 which is constructed as a bore in this instance. In a state facing away from the counter-face 44, the chisel receiving member 45 opens in a sealing portion 46 which is constructed in a bore-like manner as an inner cylinder. A seal receiving member is introduced in the wall region delimiting the sealing portion 46. The seal receiving member may, as illustrated in this instance, be constructed as a peripheral groove 46.1. The chisel receiving member 45 may also be referred to as a chisel receiver 45.

Figure 8:
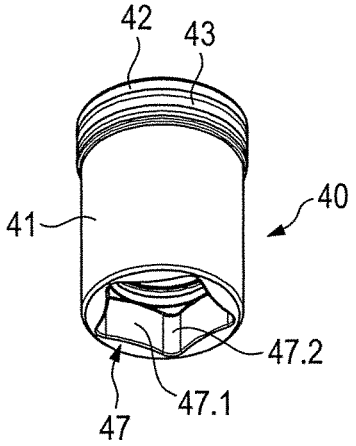
FIGS. 8 and 9 are perspective views of a chisel holder.
Figure 9:
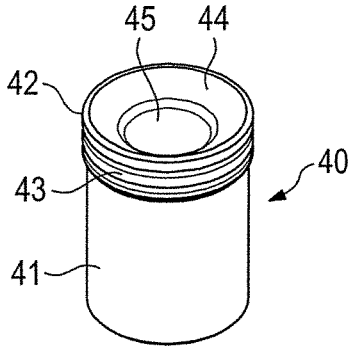
Figure 11:
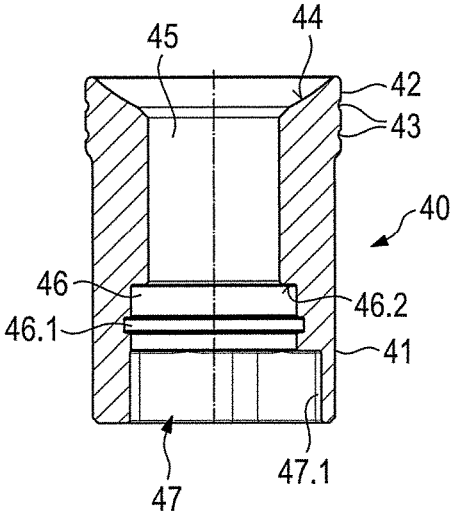
FIG. 11 shows a line of section indicated XI-XI in FIG. 10.

The chisel holder 40 has at the end thereof facing away from the cylindrical attachment 42 a holder receiving member 47. The holder receiving member 47 may also be referred to as a holder receiver 47. FIGS. 8 and 11 allow the structure of the holder receiving member 47 to be seen more clearly. As can be seen from these illustrations, the holder receiving member 47 is constructed as an internal receiving member in the chisel holder 40. It is delimited by five retention faces 47.1 which are curved in a convex manner. The retention faces 47.1 merge into each other via concave transition portions 47.2. The curvature of the retention faces 47.1 and the transition portions 47.2 is constructed to be adapted to the curvature of the blocking faces 34 and the transition portions 35 of the nut 30. Accordingly, the nut 30 can be guided from the rear end of the chisel holder 40 with the sealing portion 31 through the region of the holder receiving member 47 and pushed into the region of the sealing portion 46. The insertion movement of the nut 30 is blocked by means of the impact face 37 which comes to rest on a stop 46.2 of the sealing portion 46. In this assembly state, the seal 32 engages in the groove 46.1 of the sealing portion 46 so that the transition region between the outer contour of the nut 30 and the inner contour of the sealing portion 46 is sealed. The blocking faces 34 are arranged opposite the retention faces 47.1. The transition portions 35 and 47.2 are also opposite each other. In this manner, a non-rotatable arrangement of the nut 30 in the holder receiving member 47 is achieved. Since the seal 32 is retained in a manner clamped between the nut 30 and the chisel holder 40, the nut 30 is retained in a non-releasable manner.

Figure 12:
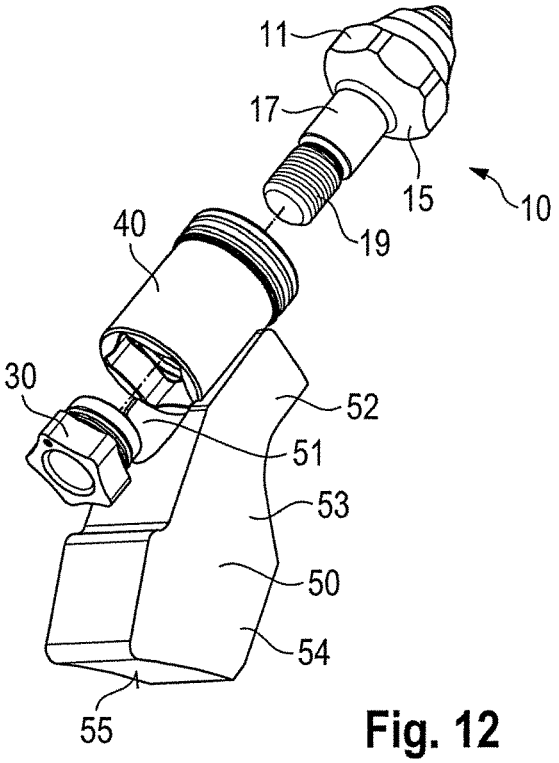
FIG. 12 is an exploded view of a chisel holder changing system.

FIG. 12 is an exploded view of a chisel holder changing system in which the chisel holder 40 is secured in a suitable manner to a lower portion 50, for example, welded. The lower portion 50 has for this purpose a securing portion 51 which in accordance with the cylindrical contour of the base portion 41 of the chisel holder 40 has a concave recess. The securing portion 51 is formed by a carrier portion 52 of the lower portion 50. The carrier portion 52 is formed integrally on a base portion 54 by means of a transition portion 53. The base portion 54 has a lower support face 55. With the support face 55, the chisel holder 40 can be placed on the outer face of a cutting roller pipe and can be secured thereto in a suitable manner, for example, welded.

Figure 13:
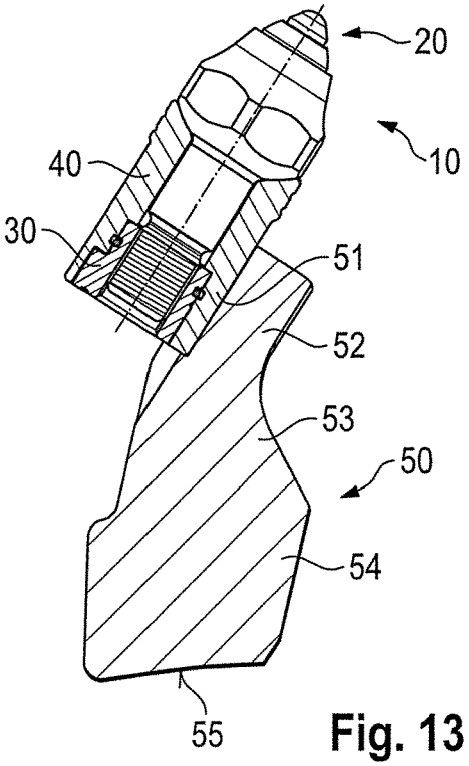
FIG. 13 is a side view and sectioned view of the chisel holder changing system according to FIG. 12.

FIG. 13 shows the above-described assembly position of the nut 30 in the holder receiving member 47. The chisel 10 can be inserted with the chisel shaft 17 thereof past the counter-face 44 into the chisel receiving member 45. In this instance, the expanding counter-face 44 facilitates the introduction movement of the chisel 10. When the thread 19 of the chisel 10 strikes the nut 30, the chisel 10 can be screwed with the thread 19 thereof into the thread 36 of the nut 30. This screwing-in movement can first be carried out by hand until the support face 15 comes to rest on the counter-face 44. Subsequently, a suitable tool can be placed on the tool receiving member 14. The chisel 10 can then be rotated with the tool and, in this instance, the threaded connection between the thread 19 and the thread 36 can then be tensioned. In order to ensure reliable fixing of the chisel 10 during the processing operations which are intended to be carried out, a high tightening torque has to be selected. In this instance, the support faces 15 and the counter-face 44 press each other. As a result of this pressing action, a seal between the chisel head 11 and the counter-face 44 is brought about in such a manner that no contamination can be introduced. Via the high torque, the expansion portion 17.1 of the chisel shaft 17 is resiliently deformed. This resilient deformation portion, in the event of loads acting on the chisel tip 20 in an impact-like manner, prevents the threaded connection between the nut 30 and the chisel shaft 17 from being able to be released. The selected geometry of the concave blocking faces 34 and the convex retention faces 47.1 enable increased force transmission regions with respect to conventional, elongate surface portions, as are conventional with nuts. Of course, the retention faces 47.1 may also be curved in a concave manner and the blocking faces 34 may accordingly be curved in a convex manner.

The convex/concave pairings selected prevent for the selected high tightening torques a plastic deformation of the blocking faces 34 or the retention faces 47.1 from being able to be produced. Consequently, in particular the holder receiving member 47 remains in the desired form and during the chisel change a new nut 30 can be inserted in a reproducible manner.

During the tool engagement, the chisel tip 20 strikes the substrate which is intended to be cut and cuts into it. In this instance, the material cut slides off the chisel tip 20. As a result of the large forces present in the region of the chisel tip 20, a great abrasive attack is brought about in this instance. This attack is taken into account by the structure of the chisel 10 with the connection portion 23, which comprises hard material, for example, hard metal. After the material removed has passed the connection portion 23, it reaches the region of the discharge face 13. It has then already lost a large proportion of its abrasive nature and can be safely guided further by the discharge face 13. In this instance, it is guided radially outward from the discharge face 13 and discharged from the tool receiving member 14 and the chisel holder 40 so that where possible it is not subjected to wear or is subjected only to slight wear.

Since the chisel 10 cannot rotate, it is first worn away at one side. This is permissible up to a specific wear limit. Then, the chisel 10 is released by means of the appropriate tool which engages on the tool receiving member 14. Subsequently, the nut 30 can be pulled from the holder receiving member 47 and inserted therein again in a rotated state. As a result of this rotation, the thread intake in the thread 36 is also arranged in a rotated position with respect to the chisel holder 40. When the chisel 10 is again screwed to the nut 30, wherein the same tightening torque is again preferably intended to be selected, then the chisel head 11, and consequently the chisel tip 20 opposite the chisel holder 40, moves into abutment in a correspondingly rotated position. The processing side of the chisel 10 is then formed by a non-worn chisel tip location.

In the present embodiment, 5 blocking faces 34 which are arranged in a state distributed in a uniform manner with respect to each other are provided on the nut 30. Accordingly, the chisel 10 may also be secured at five mutually rotated locations to the chisel holder 40. It has been found that such an arrangement is particularly advantageous when the chisel 10 is used for the purpose of fine-milling of road surfaces. When rotated by the extent of a blocking face 34, the chisel 10 can then be worn in a manner optimized in terms of wear, wherein at the same time a high surface quality of the milled road surface is retained. When six blocking faces are used, optimized use of the chisel tip 20 in terms of wear is not achieved, as is possible with 5 blocking faces. When four blocking faces are used, there is an excessively high variance in the surface quality when the chisel tip 20 is intended to be used completely. Furthermore, when 5 blocking faces are used, that is to say, an uneven number of blocking faces 34, it is also possible to operate in such a manner that the chisel 10 is always rotated to the extent of two blocking faces 34. In this manner, a continuous uniform wear of the chisel for the purpose of high surface qualities of the milled surface can be achieved.

Figure 14:
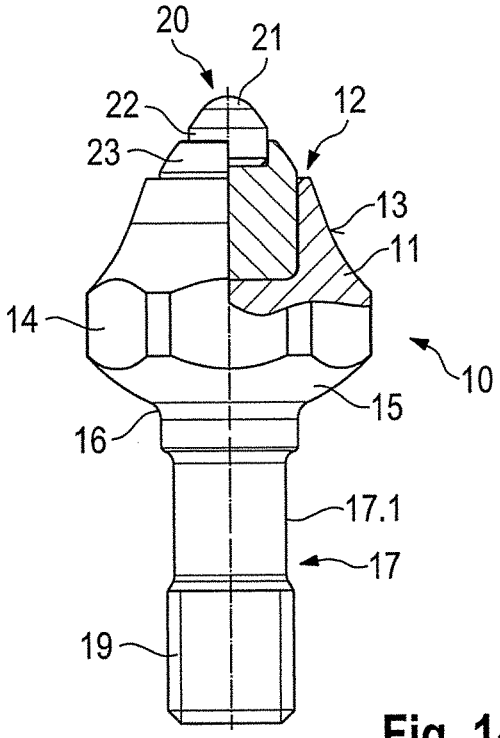
FIG. 14 is a side view of a chisel.

FIG. 14 shows another construction variant of a chisel 10. This chisel is constructed in an identical manner to the chisel 10 according to FIGS. 1 to 3 with the exception of the structure of the chisel shaft 17. Reference may therefore be made to the corresponding statements above. Furthermore, the nut 30 according to FIGS. 4 to 7 can be screwed to the thread 19 of the chisel 10 and it can accordingly be fitted in the chisel holder 40 according to FIGS. 8 to 11.

The chisel shaft 17 of the chisel 10 according to FIG. 14 has an expansion portion 17.1 which is constructed in the form of a cross-section reduction in order to achieve improved expansion behavior.

Figure 10:
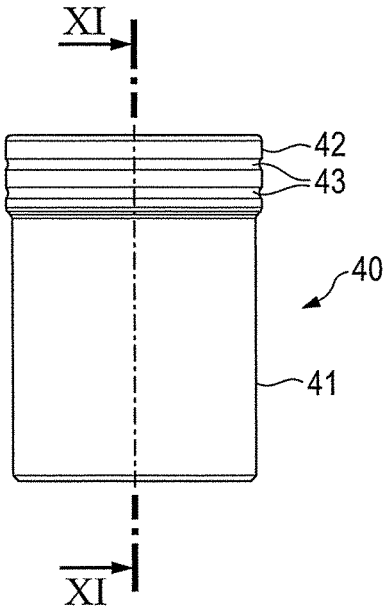
FIG. 10 is a side view of the chisel holder according to FIGS. 8 and 9.
Figure 15:
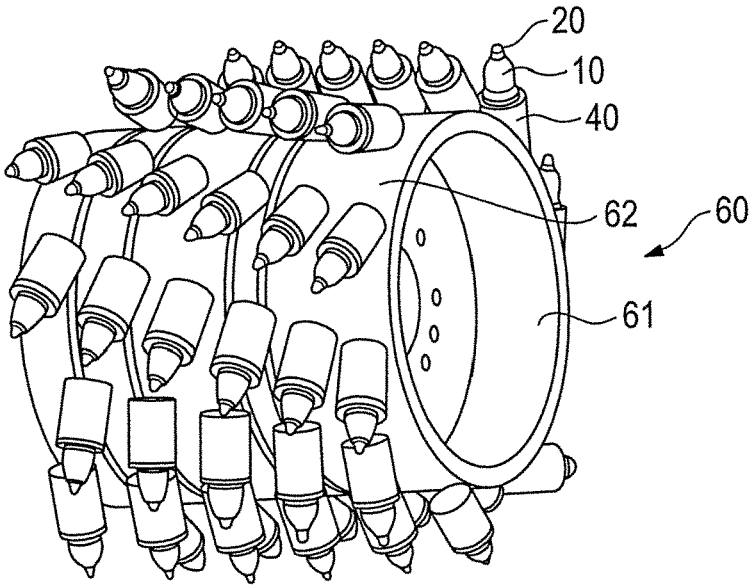
FIG. 15 is a perspective view of a milling roller of a road milling machine.

FIG. 15 shows a milling roller 60 which has a milling roller pipe 61. A large number of chisel holders 40 according to FIGS. 10 and 11 are directly secured, for example, welded to the surface 62 of the milling roller pipe 60. The chisel holders carry the chisels 10, for example, according to FIGS. 1 to 3. As described above, the chisel holder changing systems may accordingly also be fitted in accordance, for example, with FIGS. 12 and 13 with the milling roller pipe 61. To this end, the lower portions 50 are placed with the support faces 55 thereof on the surface 62 and welded to the milling roller pipe 60.

Figure 16:
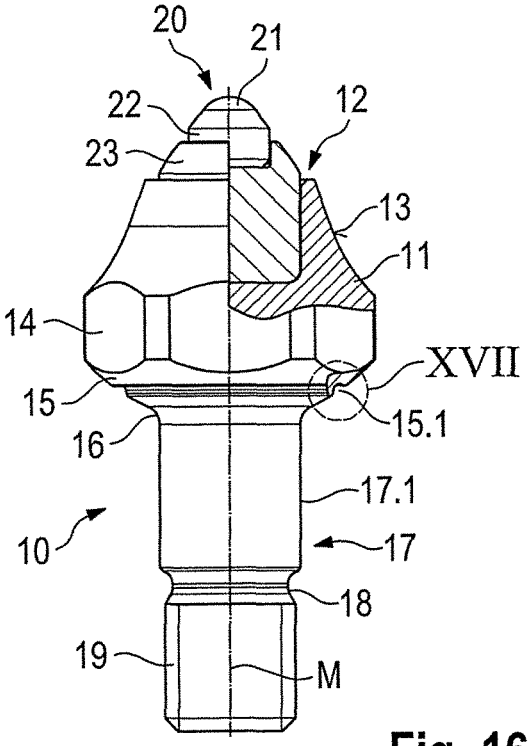
FIG. 16 is a side view and partially sectioned view of a chisel.
Figure 17:
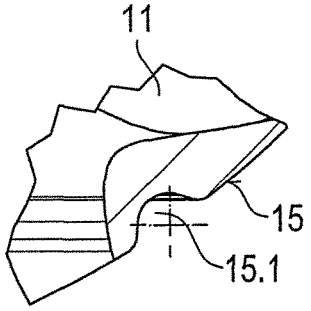
FIG. 17 shows a detail indicated in FIG. 16.
Figure 18:
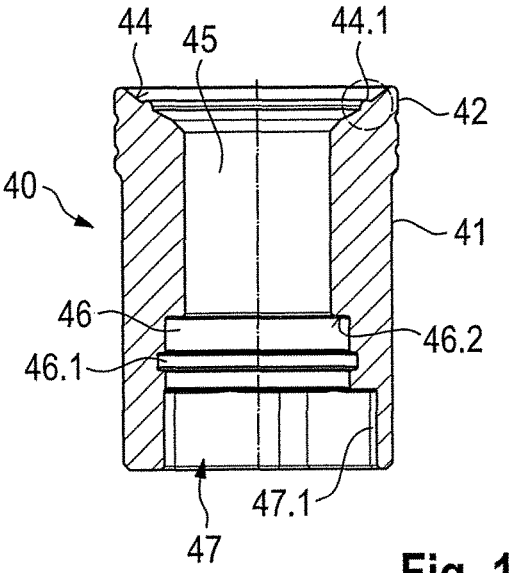
FIG. 18 is a sectioned view of a chisel holder.
Figure 19:
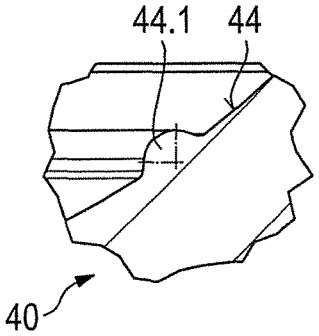
FIG. 19 is a section detail taken from FIG. 18, FIGS. 20 and 21 show another alternative construction of a chisel.

FIGS. 16 to 19 show an alternative construction of the invention to 1 to 13 or 14, wherein the chisel 10 and the chisel holder 40 are slightly modified. In order to prevent repetition, reference may therefore be made to the above statements and only the differences will be discussed below. As can be seen in FIGS. 16 and 17, in the region of the support face 15, a peripheral recess 15.1 is formed in a groove-like manner. It extends concentrically about the chisel axis M. FIGS. 18 and 19 show the chisel holder 40 which in the region of the counter-face 44 has a peripheral projection 44.1. It is constructed in a bead-like manner and also extends concentrically about the longitudinal center axis of the chisel holder 40. The positioning of the projection 44.1 is selected in such a manner that, in the assembled state of the chisel 40, it engages in the recess 15.1. In this manner, a labyrinth-like seal is formed in the region of the support face 15/counter-face 44, and impedes the introduction of dirt into the region of the chisel receiving member 45. Furthermore, the support face 15 is interrupted with the recess 15.1 so that reliable surface contact with respect to the counter-face 44 is always ensured, even with production tolerances.

In place of the projection 44.1, it is also possible to use a ring, for example, a sealing ring, in particular a commercially available O-ring or a copper ring or a similar metal ring. This may be laid in a peripheral groove of the chisel holder 40 in the region of the counter-face 44. With the region thereof which protrudes over the counter-face 44, this sealing ring then engages in the recess 15.1.

Figure 20:
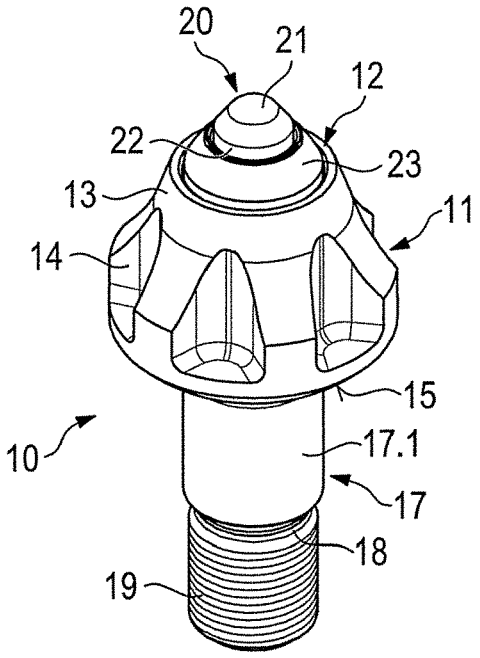
Figure 21:
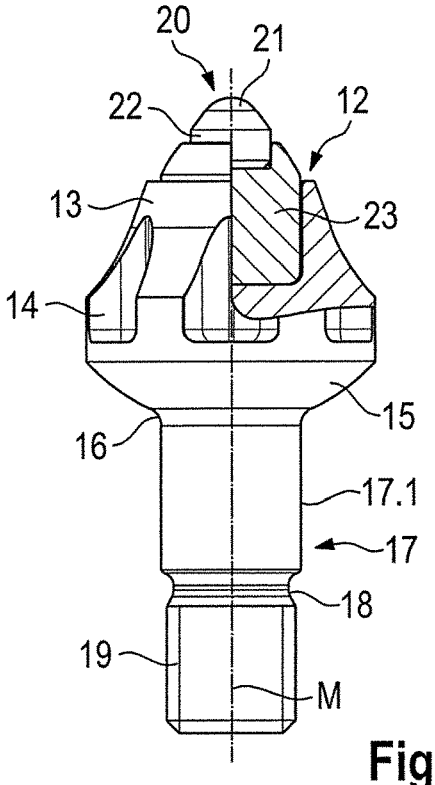

FIGS. 20 and 21 show another embodiment of a chisel 10. This chisel is constructed in accordance with the chisel 10 according to FIGS. 1 to 3, for which reason, in order to prevent repetition, only the differences are intended to be discussed below. The chisel head 11 is provided with a plurality of tool receiving members 14 on an outer periphery. These may be formed as recesses in the outer contour of the chisel head 11. The recesses are open in a radially outward direction and in an axially upward direction. Consequently, a tool can be readily fitted from the chisel tip 20. Furthermore, the tool receiving members 14 cannot become clogged with waste material or are easy to clean where applicable.

FIGS. 22 to 27 show various embodiments of chisel holder changing systems, in which the above-described chisels 10 can be used together with the nut 30 according to FIGS. 4 to 7. In these drawings, for the identification of identical or equivalent components, the same reference numerals as above are used. Reference may therefore be made in full to the statements above.

Figure 22:
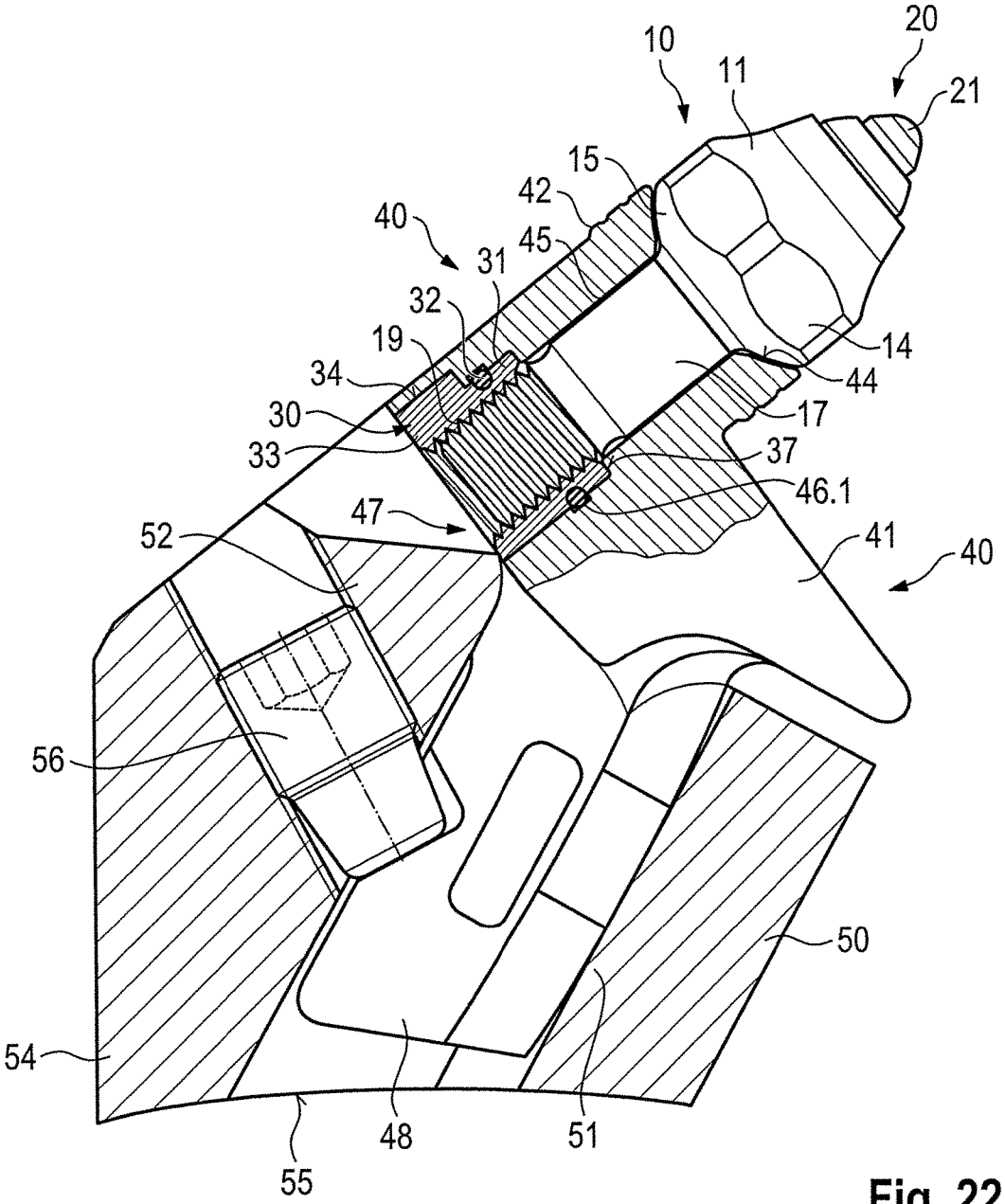
FIG. 22 is a section through a chisel holder changing system.

FIG. 22 shows a tool holder changing system having a tool holder 40, which carries at a base portion 41 an integrally formed plug type attachment 48. A cylindrical attachment 42 is further formed on the base portion 41. In the region of the cylindrical attachment 42, a counter-face 44 corresponding to the support face 15 is again constructed in accordance with the chisel holder 40 according to FIGS. 8 to 11. In the base portion 41 and the cylindrical attachment 42, there is formed a chisel receiving member 45 which terminates in a sealing portion 46. The sealing portion 46 is again adjoined by the holder receiving member 47, in which the nut 30 according to FIGS. 4 to 7 is inserted. In this instance, the nut 30 again has a securing portion 33 with blocking faces 34. The blocking faces 34 cooperate with retention faces 47.1 of the chisel holder 40 in order to secure the nut 30 in a rotationally secure manner. The nut 30 is again sealed with the sealing portion 31 thereof and the seal 32 on the sealing portion 46 of the chisel holder 40.

As can further be seen in FIG. 22, the chisel 10 with the thread 19 is screwed into the thread 36 of the nut 30 until the impact face 37 strikes the chisel holder 40.

The chisel holder 40 is inserted with the plug type attachment 48 thereof into a plug type receiving member of a lower portion 50. The chisel holder 40 is supported with respect to the lower portion 50 and is retained in the lower portion 50 with a pressure screw 56 which acts on the plug type attachment 48.

Figure 23:
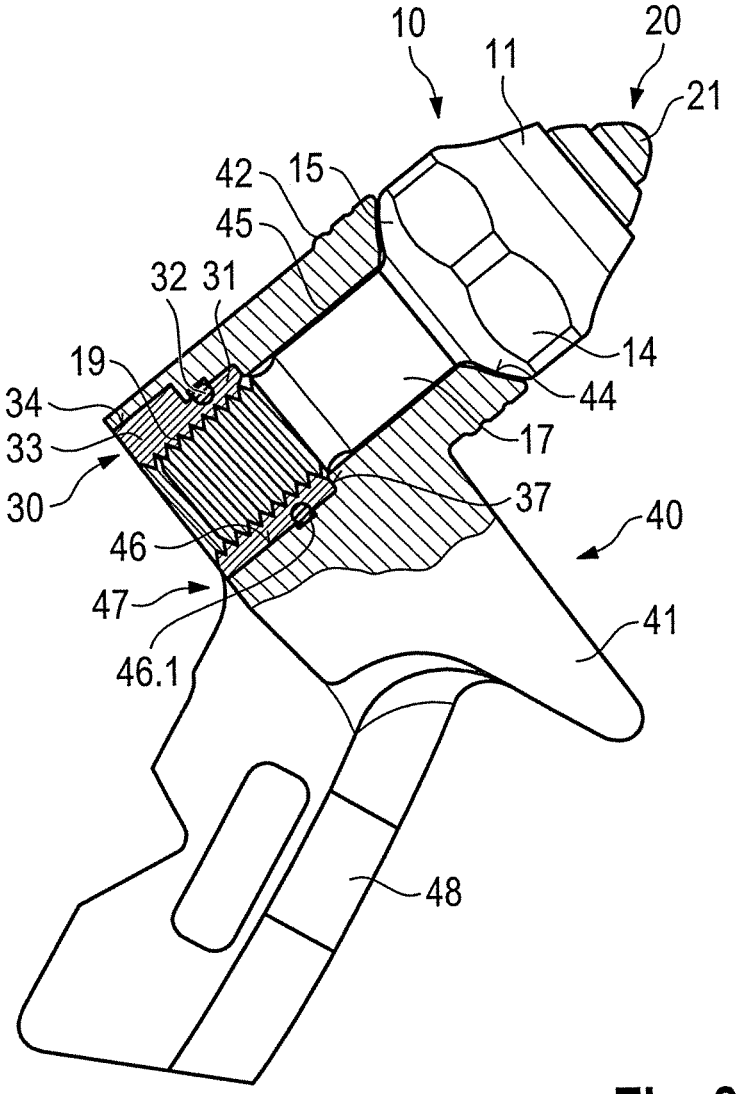
FIG. 23 is a side view and partially sectioned view of a chisel holder according to FIG. 22, FIGS. 24 to 27 are side views of different versions of chisel holder changing systems.

FIG. 23 shows the combination of the chisel holder 40 with the chisel 10, as described above with reference to FIG. 22.

Figure 24:
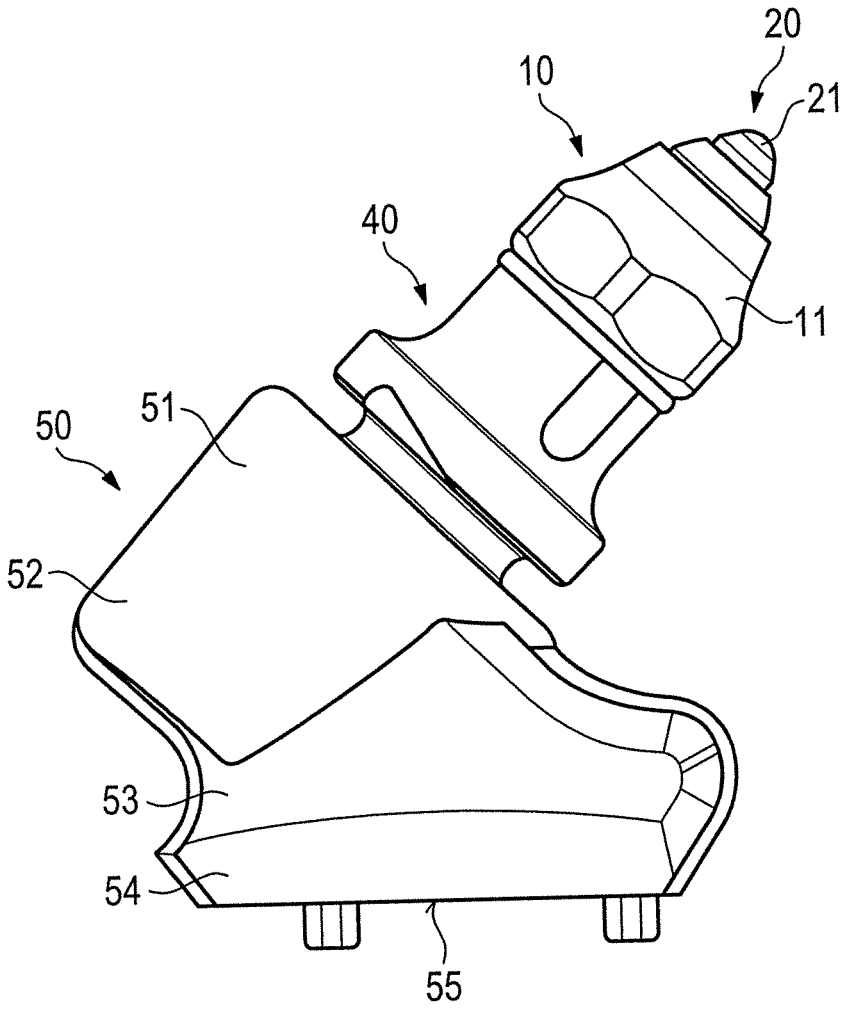

FIG. 24 shows another chisel holder changing system. Accordingly, there is again used a chisel holder 40 which receives the chisel 10 and the nut 30 in the manner described above. The chisel holder 40 is retained in a lower portion 50 with a plug type attachment which cannot be seen in FIG. 24.

Figure 25:
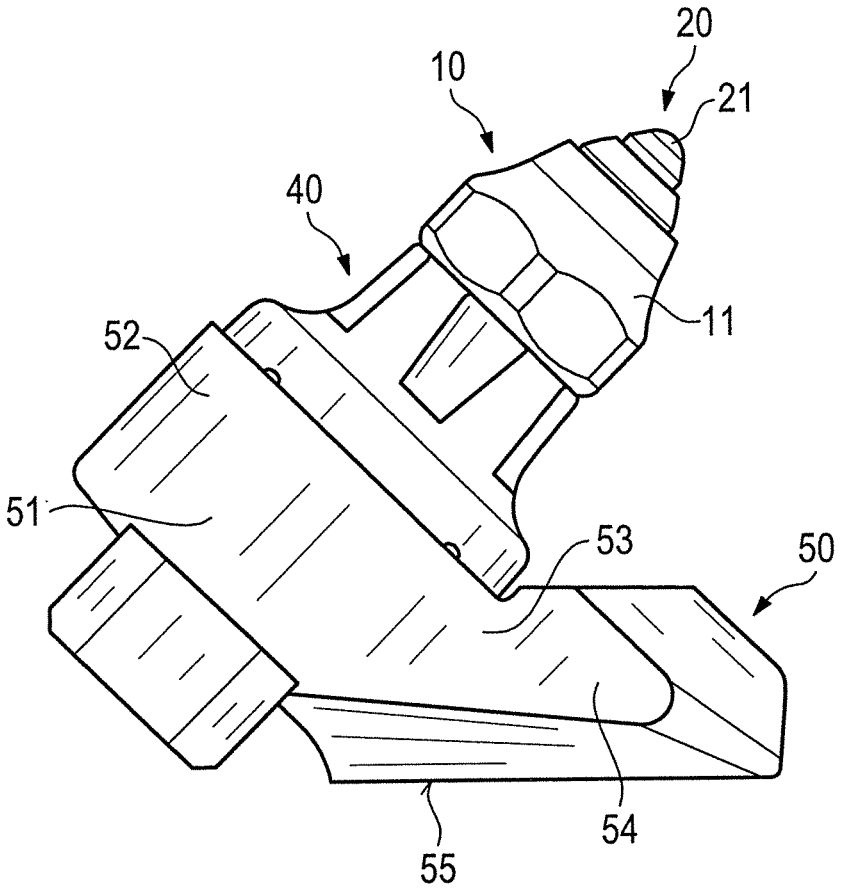

FIG. 25 shows a construction variant of a chisel holder changing system having a chisel holder 40 and a lower portion 50.

Figure 26:
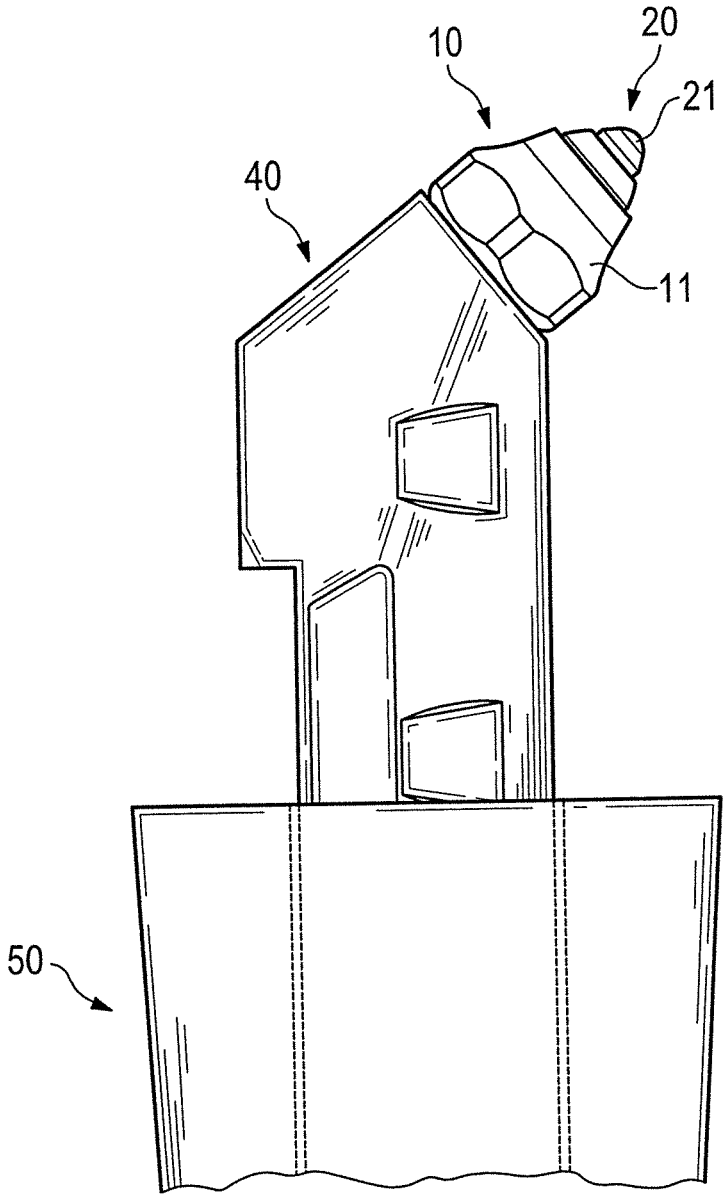

FIG. 26 shows another construction variant of a chisel holder changing system having a chisel holder 40 and a lower portion 50 which receives the chisel holder 40.

Figure 27:
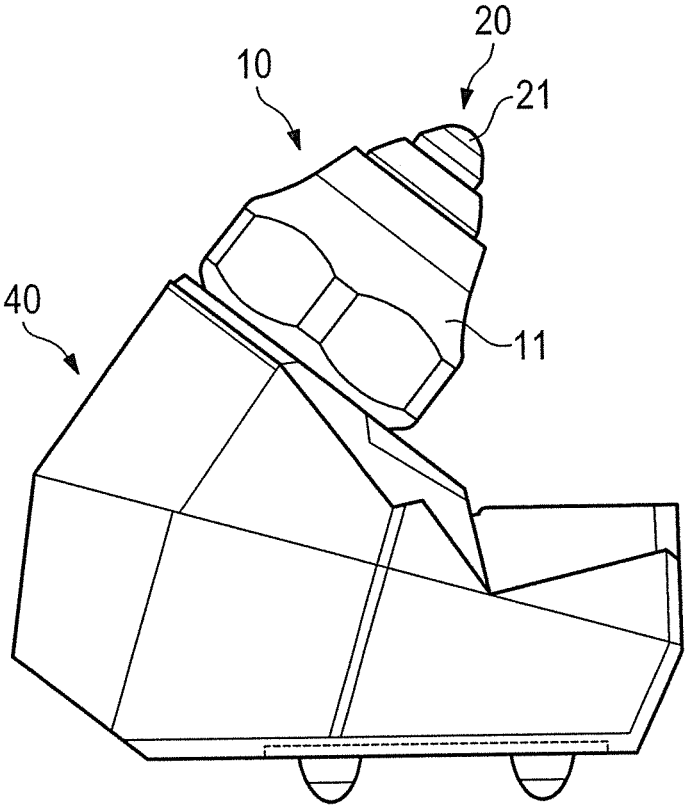

FIG. 27 discloses a tool system having a chisel holder 40, in which the chisel 10 is inserted. The chisel holder 40 can be placed directly on the surface 62 of a milling roller pipe 60 and secured thereto, for example, welded.

The invention claimed is:

1. A chisel holder and chisel combination apparatus for a ground processing machine, comprising:

a chisel holder including a base portion including:

a chisel receiver, the chisel receiver including a chisel introduction region; and a holder receiver connected to the chisel receiver, the holder receiver including more than two retention faces, a nut received in the holder receiver and including a securing portion having more than two blocking faces arranged opposite the more than two retention faces of the holder receiver such that the nut is rotationally secured within the holder receiver by engagement of the blocking faces with the retention faces, the nut including an internal thread; and a chisel including a chisel shaft arranged at least partially in the chisel receiver, the chisel shaft including a thread portion including an external thread screwed into the internal thread of the nut.

2. The apparatus of claim 1, wherein the retention faces include curved surface regions.

3. The apparatus of claim 2, wherein the curved surface regions are convex and each retention face merges into an adjacent retention face via a concave transition.

4. The apparatus of claim 1, wherein the retention faces are arranged such that the retention faces are distributed in a substantially uniform manner over a periphery of the holder receiver.

5. The apparatus of claim 1, further comprising a holder seal portion including a cylindrical bore of the chisel receiver, the holder receiver merging into the holder seal portion.

6. The apparatus of claim 5, wherein the holder seal portion further includes a stop for the nut.

7. The apparatus of claim 1, wherein the base portion includes a spherically concave counter-face opposite the holder receiver.

8. The apparatus of claim 7, wherein the base portion further includes:

an at least partially cylindrical outer contour; and a cylindrical attachment forming at least part of the counter-face.

9. The apparatus of claim 7, further comprising at least one of a peripheral projection and a peripheral recess arranged on the counter-face.

10. The apparatus of claim 1, wherein the nut further comprises a nut seal portion adjacent to the securing portion, the nut seal portion sealingly inserted into a holder seal portion of the chisel holder; and further including an o-ring seal sealing between the nut seal portion and the holder seal portion.

11. The apparatus of claim 1, wherein the chisel further comprises a chisel head including a spherically curved support face tapered from the chisel head toward the chisel shaft, the support face supported by a counter-face of the chisel holder.

12. A method of assembling a chisel in a chisel holder, the method comprising:

placing a nut in a holder receiver of the chisel holder such that the nut is rotationally secured in a first position;

retaining the nut in the chisel holder with a seal before the chisel is screwed into the nut;

placing the chisel into a chisel receiver of the chisel holder; and screwing the chisel into the nut until a support face of the chisel is tensioned on a counter-face of the chisel holder.

13. The method of claim 12, further comprising:

removing the nut from the first position and placing the nut in the holder receiver in a second position offset relative to the first position in a peripheral direction; and wherein a thread intake of the nut is offset corresponding to an offset of the second position relative to the first position such that the chisel may be assembled in either of the first and second positions.

14. The method of claim 12, wherein:

the seal is an o-ring seal received in an annular groove of the holder receiver.

15. A chisel holder for a ground processing machine, the chisel holder comprising:

a base portion having a generally cylindrical outer surface and having first and second ends, with an internal passage extending through the base portion from the first end to the second end;

a counter-face defined on the base portion adjacent the first end for supporting a chisel head of a chisel;

a securing portion defined on the base portion adjacent the second end and including more than two retention faces for engaging a nut to hold the nut against rotation relative to the base portion when the nut is received in the securing portion, the plurality of retention faces being distributed in a substantially uniform manner around a periphery of the securing portion;

a sealing portion defined in the internal passage on an opposite side of the securing portion from the second end, the sealing portion including an annular groove defined therein for receiving a seal;

the internal passage including a bore extending from the counter-face to the sealing portion; and a stop surface joining the sealing portion and the bore for limiting movement of the nut toward the first end.

* * * * *